US010117010B2

(12) United States Patent
Spector et al.

(10) Patent No.: US 10,117,010 B2
(45) Date of Patent: Oct. 30, 2018

(54) WIRELESSLY CAPABLE SPORTS MOUTHGUARD FOR COMMUNICATION

(71) Applicants: Cole Garrett Spector, Raleigh, NC (US); Greyson Evan Spector, Raleigh, NC (US); Cade Wolfram Spector, Raleigh, NC (US); Sawyer Beckett Spector, Raleigh, NC (US)

(72) Inventors: Cole Garrett Spector, Raleigh, NC (US); Greyson Evan Spector, Raleigh, NC (US); Cade Wolfram Spector, Raleigh, NC (US); Sawyer Beckett Spector, Raleigh, NC (US)

( * ) Notice: Subject to any disclaimer, the term of this patent is extended or adjusted under 35 U.S.C. 154(b) by 0 days.

(21) Appl. No.: 15/260,029

(22) Filed: Sep. 8, 2016

(65) Prior Publication Data

US 2017/0070797 A1 Mar. 9, 2017

Related U.S. Application Data

(60) Provisional application No. 62/215,716, filed on Sep. 8, 2015.

(51) Int. Cl.
*H04R 1/02* (2006.01)
*A63B 71/08* (2006.01)

(52) U.S. Cl.
CPC ..... *H04R 1/028* (2013.01); *A63B 71/085* (2013.01); *A63B 2071/088* (2013.01); *H04R 2420/07* (2013.01); *H04R 2460/13* (2013.01)

(58) Field of Classification Search
CPC ..... H04R 2420/07; H04R 2460/13; A63B 71/085; A63B 2071/088
See application file for complete search history.

(56) References Cited

U.S. PATENT DOCUMENTS

| | | | | |
|---|---|---|---|---|
| 5,706,251 | A | 1/1998 | May | |
| 7,269,266 | B2 | 9/2007 | Anjanappa et al. | |
| 7,664,277 | B2 | 2/2010 | Abolfathi et al. | |
| 2006/0065277 | A1 | 3/2006 | Jacobs | |
| 2009/0017422 | A1* | 1/2009 | Creamer | A61C 19/06 433/215 |
| 2009/0208031 | A1* | 8/2009 | Abolfathi | H04R 25/606 381/74 |
| 2009/0210231 | A1* | 8/2009 | Spiridigliozzi | A61F 5/58 704/271 |

(Continued)

FOREIGN PATENT DOCUMENTS

WO WO2017/044621 3/2017

OTHER PUBLICATIONS

International Search Report and Written Opinion for Application No. PCT/US16/50774 dated Nov. 29, 2016.

(Continued)

*Primary Examiner* — Tuan D Nguyen
(74) *Attorney, Agent, or Firm* — Jenkins, Wilson, Taylor & Hunt, P.A.

(57) ABSTRACT

A mouthguard configured to receive wireless audio signals and transmit these audio signals to a user via bone conduction may include one or more wireless antenna, a controller, a power storage device, an external power and/or data port, and one or more bone conduction speakers. The mouthguard is inserted in the user's mouth to protect against dental injuries as well as to enable communication between the user and a remote audio source. The inner surface of the mouthguard contacts the user's teeth for transmitting audio content to the user and audio content is transmitted to the wireless antenna of the mouthguard.

20 Claims, 6 Drawing Sheets

(56) References Cited

U.S. PATENT DOCUMENTS

| | | | | |
|---|---|---|---|---|
| 2009/0226011 | A1 | 9/2009 | Abolfathi et al. | |
| 2009/0253951 | A1 | 10/2009 | Ball et al. | |
| 2009/0268932 | A1* | 10/2009 | Abolfathi | H04R 25/606 381/312 |
| 2011/0184319 | A1 | 7/2011 | Mack et al. | |
| 2013/0121113 | A1 | 5/2013 | Imran | |
| 2014/0257051 | A1* | 9/2014 | Cam | A61B 5/682 600/301 |
| 2014/0349597 | A1 | 11/2014 | Abolfathi et al. | |

OTHER PUBLICATIONS

Benson, B.W., et al., "Is protective equipment useful in preventing concussion? A systematic review of the literature," Br. J. Sports Med, 43(Suppl I), pp. i56-i67 (2009).

Knapik, J., et al., "Mouthguards in Sport Activities: History, Physical Properties and Injury Prevention Effectiveness," Sports Medicine, 37(2), pp. 120-121 (2007).

McGuine, T., et al., "Protective Equipment and Player Characteristics Associated With the Incidence of Sport-Related Concussion in High School Football Players: A Multifactorial Prospective Study," Am J Sports Med, 42(10), pp. 2470-2478 (2014).

Murray, M., et al., "Efficacy and Safety of an In-the-Mouth Bone Conduction Device for Single-Sided Deafness," Otology & Neurotology, 32 (3), pp. 437-443 (2011).

Notice of Publication for Application No. PCT/US2016/050774 dated Mar. 16, 2017.

Zadik, Y., et al., "Does a free-of-charge distribution of boil-and-bite mouthguards to young adult amateur sportsmen affect oral and facial trauma?" Dent Traumatology, 25 (1): 69-72 (2009).

* cited by examiner

WIRELESSLY CAPABLE SPORTS MOUTHGUARD FOR COMMUNICATION

CROSS-REFERENCE TO RELATED APPLICATION

The present application claims priority to and the benefit of U.S. Patent Application Ser. No. 62/215,716, filed Sep. 8, 2015, the disclosure of which is incorporated herein by reference in its entirety.

TECHNICAL FIELD

The subject matter disclosed herein relates generally to dental protection accessories and communication devices. More particularly, the subject matter disclosed herein relates to protective mouthguards with electronics for communication.

BACKGROUND

Conventional mouthguards are typically unable to transmit any sound to the user of the mouthguard. Furthermore, in a sporting environment, which is a very common place where conventional mouthguards are used, it can often be difficult for participants to communicate with coaches or instructors while wearing a conventional mouthguard. Often times, coaches or instructors have information which can be time-sensitive and which needs to be transmitted to a participant in real-time. Furthermore, the need for a participant to be able to be fully aware of his or her surroundings while participating in a given activity is of paramount importance. The need for situational awareness is of great importance while engaged in a sporting activity as well as when walking, running, or cycling in public, where dangerous collisions may not be able to be avoided when conventional personal audio devices (e.g., headphones or earphones, which isolate a user from hearing ambient noise) are used. While the use of conventional audible speaker arrangements for communications between a coach and a participant has become widespread in many sporting activities (e.g., football), issues of audio clarity, the audio being drowned out by crowd noise, and the need for extensive infrastructure and modification of existing sporting equipment presents a multitude of drawbacks. The field of bone conduction audio devices is a rapidly expanding market, seeking to prevent dangerous interactions while a user is wearing such bone conduction headphones, but virtually all require the user to wear an external apparatus in addition to whatever other protective equipment may be desired. Thus, the need for a mouthguard that can transmit audio to a user is an unmet need.

SUMMARY

In one aspect, a mouthguard is provided which is configured to receive an input signal from a remote source, to process the input signal, and to output an audio signal to one or more speakers inside the mouthguard.

The number and location of the one or more speakers can be selected based on a desired level of audio fidelity. For example, the one or more speakers may be located in a bottom surface of the mouthguard, such that the audio signal from each speaker is conducted into the bottom surface of the teeth contacting each respective speaker. In other embodiments, the one or more speakers may be located in a vertical outer portion of the mouthguard to contact the sides of the teeth adjacent to each speaker. In some embodiments, the one or more speakers may be located on an exposed portion of the mouthguard and, therefore, will be in direct contact with the adjacent teeth of the user. In other embodiments, the one or more speakers may be molded entirely within the mouthguard, such that an intermediate layer of suitably audio conducting material will be located between each speaker and the adjacent teeth. The speakers may be configured to transmit a same audio content or different audio content (e.g., stereo music or a combination of different audio sources). As such, a single mouthguard may be utilized differently depending on the situation presented. For example, when an athlete is training, it may be desired to allow stereo audio transmission (e.g., music) or a split audio transmission consisting of music through one speaker and communication from a coach or instructor through another speaker. However, during an athletic competition, it may be desired to only allow for communication from a coach or instructor to minimize potential distractions.

In an example embodiment, the mouthguard may be constructed of one or more layers, including a hard layer, such as plastic or any other suitable material, for improved impact resistance and a softer, more compliant external layer which enhances the contact area with the teeth of the user being used to transmit audio to the user.

In another aspect, the mouthguard has a controller which is in communication with the one or more speakers as well as one or more wireless antennas. The one or more wireless antennas are configured to receive data, in the form of an audio transmission, from one or more external sources. The data received may be transmitted via any suitable communications protocol, including, but not limited to, BLUETOOTH®, WiFi, radio frequency (RF), and/or near-field communication (NFC). The one or more antennas may be integrated into the controller or discretely located elsewhere in the mouthguard. The controller may include one or more of for example, a microcontroller, a system-on-chip (SoC), a digital signal processor for audio processing, an analog-to-digital (A2D) converter, a receiver circuit, a power storage device, an onboard storage device, and/or a communications software stack to store and enable various communications protocols. The SoC may include a processor and a memory.

The controller may be configured to receive multiple data transmissions simultaneously and to process these signals to output desired audio content to each of the one or more speakers. According to another aspect, the controller may be configured to receive encrypted communications, perform a decryption algorithm, and then play the decrypted audio content for the user. In yet another aspect, the controller may include one or more amplification modules configured to amplify the signals received by the one or more wireless antennas. In some aspects, the controller and the one or more speaker may be either integrated with or separate from each other.

In a further aspect, the mouthguard includes an energy storage device which is coupled to the controller and the speakers. According to one embodiment, the power source is connected to a port located at an external part of the mouthguard. The external port is configured to receive power and/or data transmission from a wired source, such as from an external power source and/or a personal computing device. The external port is configured to be sealingly covered during use (e.g., by a compatible plug member or by an interlocking strap used to secure the mouthguard to an external object, such as a helmet) to prevent moisture intrusion. In another embodiment, the mouthguard may include an onboard storage device which is connected to at least the external port and the controller. The onboard storage device may employ any suitable storage medium (e.g., non-volatile memory) and may be configured to receive and store data (e.g., in the form of audio files, such as music) which can be accessed by the controller and output one or more of the one or more speakers.

In another embodiment, the mouthguard may be externally sealed to give the mouthguard enhanced ruggedness capabilities by protecting against moisture and/or particulate intrusion. In one such sealed embodiment, the mouthguard may have a single-use power source inside, with the mouthguard only functioning as a conventional mouthguard after the single-use power source is depleted. In another fully sealed embodiment, the mouthguard may include a micro power generator which is configured to convert kinetic energy generated by movement of the user into power which may be consumed by the controller and speakers during normal operation and/or stored within an internal power storage device for later use.

In some aspects, the mouthguard may be equipped with a remote charging device which is capable of wirelessly receiving power for storage within the mouthguard. An example of such wireless power transmission is accomplished via inductive charging.

A person of ordinary skill in the art will understand that each of the power transmission and storage features recited herein are not mutually exclusive and may be readily combined in various permutations by such a person of ordinary skill in the art.

In yet another aspect, the mouthguard may include an onboard storage device, integral with or separate from the controller, the onboard storage device being configured to store data (e.g., audio files and/or data files). In some embodiments, this data can be transmitted to the mouthguard wirelessly. In other embodiments, a cable may be plugged into the external port connector on one end, with the other end of the cable being plugged into a computing device (e.g., a computer, tablet, smartphone). The onboard storage device may be connected to and accessible by the controller, with the controller being configured to play the data, if the data is in an audio file format. In some aspects, the data may be input via the external port connector and stored in the onboard storage device.

According to some embodiments, the data transmission from an external source may be accomplished via a wireless "ad hoc" connection. According to other embodiments, an external network may be employed to receive the data transmitted from the external source and wirelessly relay the data to the mouthguard. In some embodiments, a single external source may be connected to a plurality of mouthguards, with the mouthguards having unique identifiers (UIDs). In such a situation, it is envisioned that the external source may select one, multiple, or all UIDs of the plurality of mouthguards to receive a given data transmission, thereby allowing a coach or instructor to communicate with only one or as many as all participants wearing a mouthguard.

In another embodiment, the mouthguard may be configured with retaining features within the external port which enable a tether to be securely attached to the mouthguard, the tether being configured to be attached to an external structure and, preferably, to form a seal with the external port to prevent moisture or particulate intrusion.

DETAILED DESCRIPTION

Figure 1:
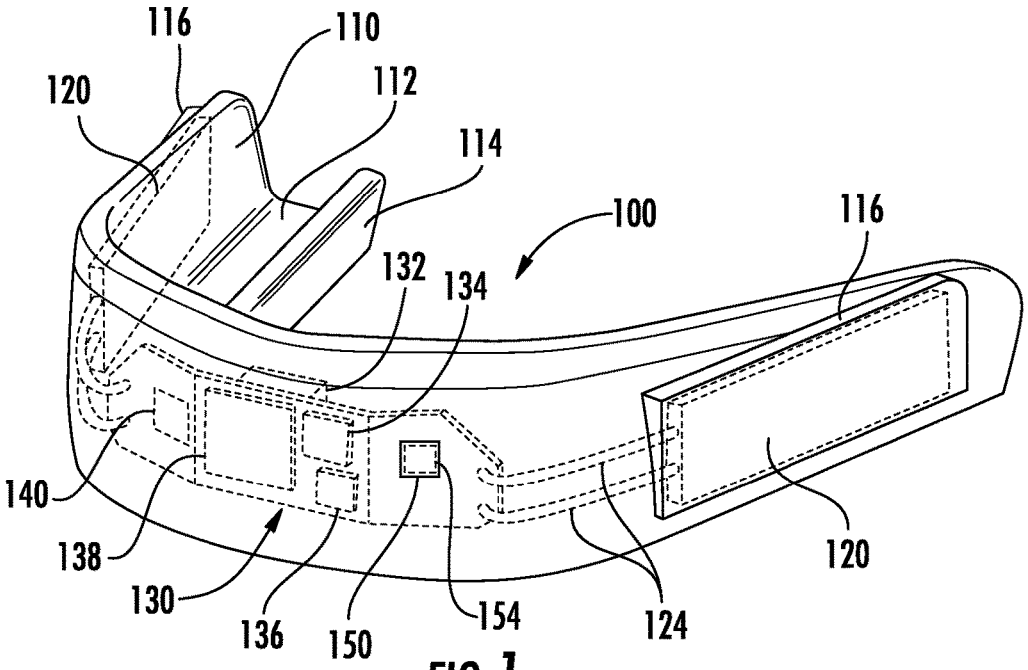
FIG. 1 is a perspective external view which also shows internal components of a mouthguard according to a first embodiment.
Figure 2:
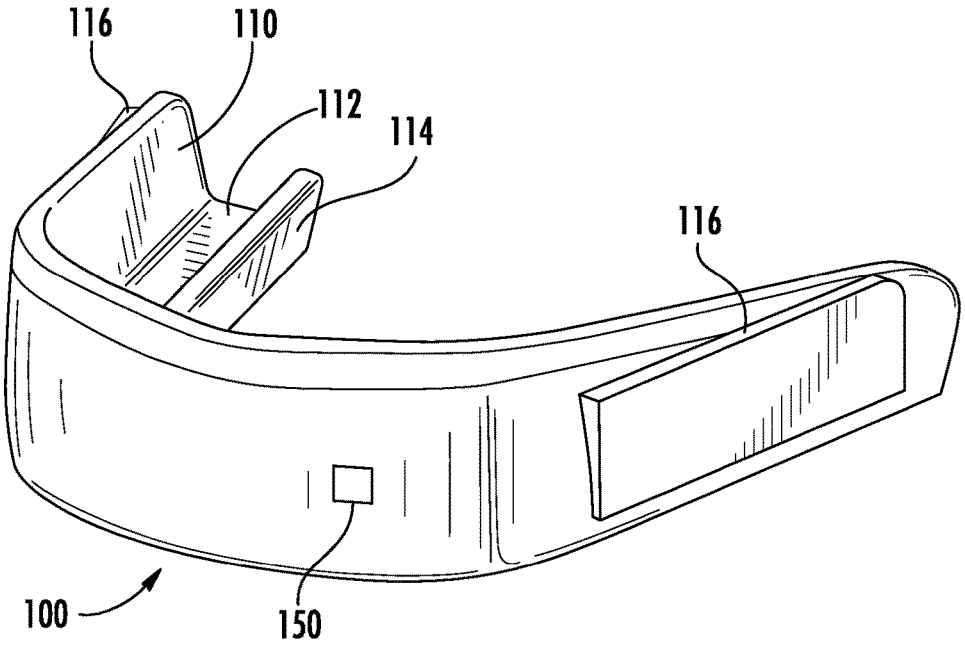
FIG. 2 is a perspective external view of the mouthguard according to the first embodiment.
Figure 3:
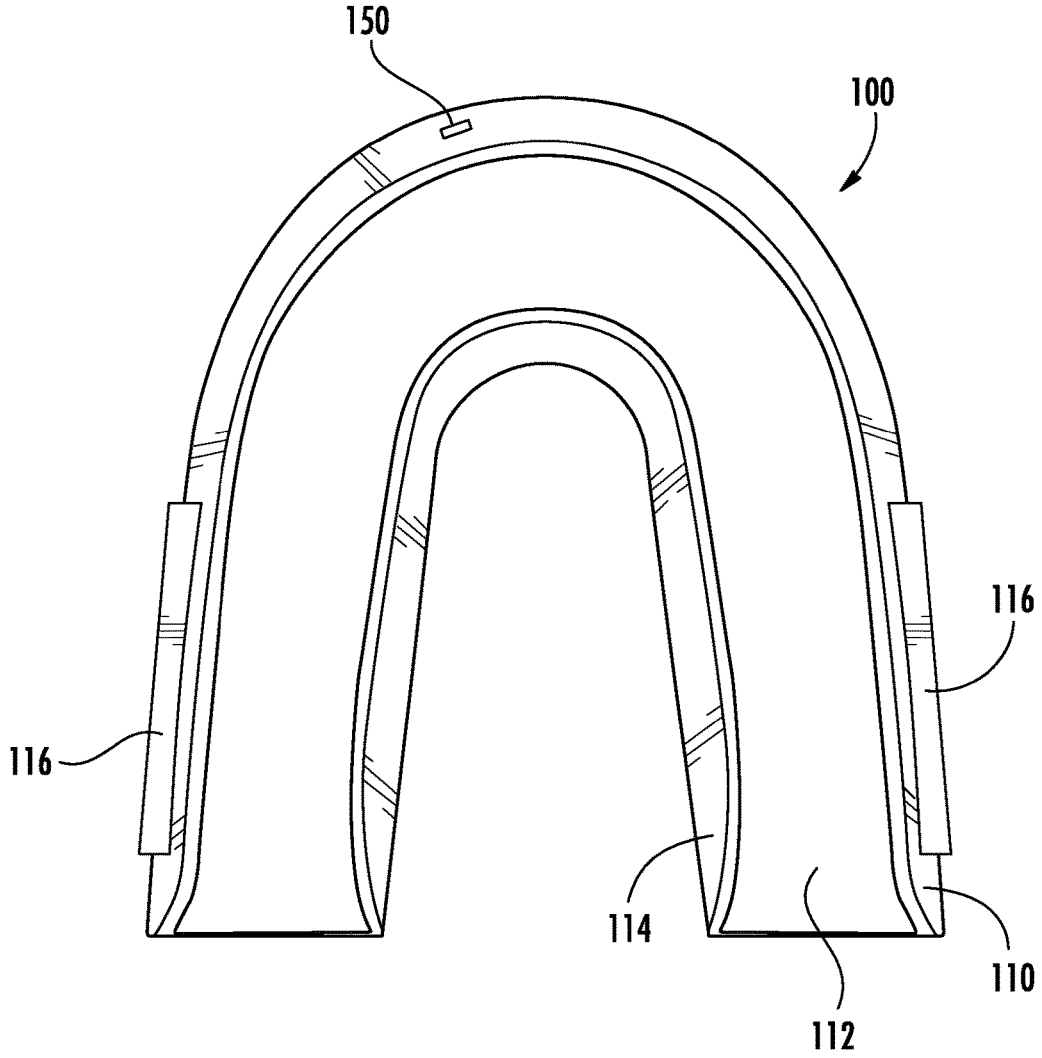
FIG. 3 is a top view of the mouthguard according to the first embodiment.
Figure 4:
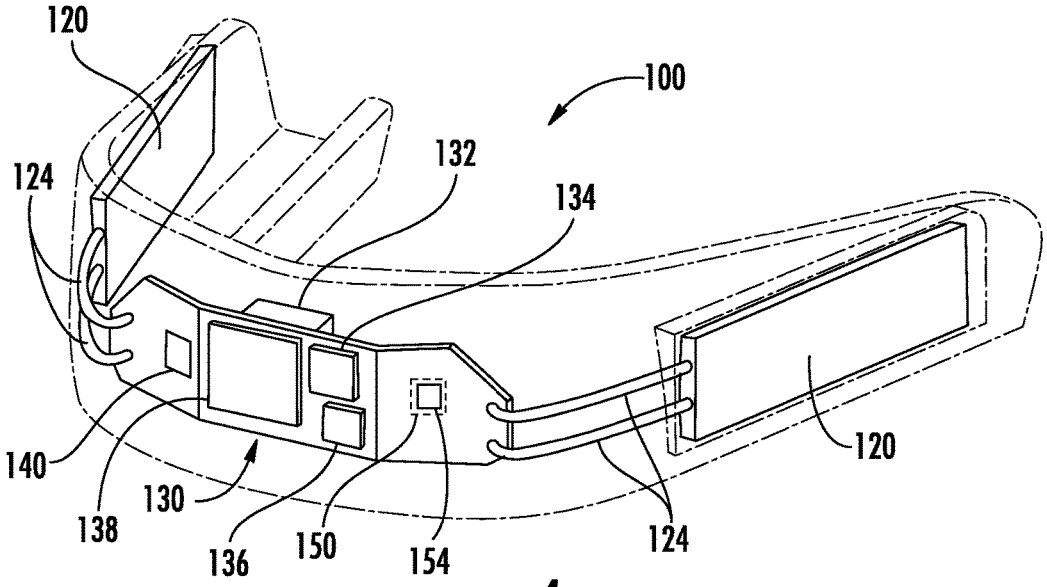
FIG. 4 is a perspective view showing the internal components of the mouthguard according to the first embodiment, with the outer contours of the mouthguard being shown in broken lines.

The presently disclosed subject matter addresses problems encountered in communicating using conventional mouthguards, including systems and devices. These systems and devices are configured to allow for wireless audio communication between a remote data source and a user of the mouthguard, with the mouthguard inserted into the user's mouth and contacting the user's teeth. The mouthguard is configured to transmit an audio signal to a user, the audio signal being transmitted to the user via bone conduction through the user's teeth. The following example embodiments are provided for purposes of illustrating the subject matter and are not intended to be interpreted as in any way limiting the scope of the subject matter claimed.

FIGS. 1 through 11 illustrate various views, aspects, and/or features associated with wirelessly communication configured mouthguard devices and systems. In some embodiments, the wireless communication configured mouthguard devices and systems set forth herein are configured to receive a data transmission, process the data transmission, and transmit the data transmission in an audio format to the user via bone conducting speakers.

Referring to FIGS. 1 through 4, a first example embodiment of a mouthguard, generally designated 100, is shown. The mouthguard 100 is configured for wireless communication from a remote source (200, See FIGS. 10 and 11). The mouthguard 100 has an outer portion 110 configured to interface with an outer surface of the teeth of the user when in an installed position, an inner portion 114 configured to interface with an inner surface of the teeth of the user when in the installed position, and a bottom portion 112 configured to interface with a bottom surface of the teeth of the user when in the installed position.

According to the first embodiment, the outer portion 110 has speaker protrusions 116 on the outside of each lateral end of outer portion 110. Speakers 120 configured to transmit sound to a user via bone conduction are located at least partially within each speaker protrusion 116. Speakers 120 are shown as being embedded within an inner layer outer portion 110 of mouthguard 100 and are therefore separated from direct contact with the user's teeth, however speakers 120 may be configured to make direct contact with the user's teeth in other embodiments. Speakers 120 can be connected to a controller, generally designated 130, by connecting wires 124.

Controller 130 is configured to receive an audio signal from one or more wireless antennas either integrated within controller 130 or otherwise embedded within the mouthguard, to perform any necessary processing of the audio signal, and to send the processed audio signal to speakers 120 in a compatible format, preferably a digital format. Controller 130 can include or be in electrical communication with any suitable antenna, such as for example a BLUETOOTH® antenna 140 and/or a WiFi antenna 138, both of which are preferably located at a front portion of outer portion 110. While BLUETOOTH® antenna 140 and WiFi antenna 138 are shown as being integral with or mounted onto controller 130, they may be located remote from and connected to controller 130 in order to ensure their optimal placement for receiving incoming data signals. Controller 130 further has a System-on-Chip 134 (SoC), which has a processor and memory onboard the SoC, as well as an onboard storage device 136 and a power storage device 136.

Mouthguard 100 can further include an external port 150, behind which can be an external port connector 154. External port 150 is configured to, in a closed position, seal external port connector from moisture and particulate intrusion during use. When external port is in an open position, external port connector 154 is connected to controller 130 and is configured to receive data and/or power from a wired source (e.g., wired source 180 shown in FIG. 9) via a wired connection (e.g., cable 160 shown in FIG. 9). External port connector 154 can be, for example, a micro-USB connector. Data and/or power received by mouthguard 100 by external port connector 154 can be transmitted and stored within an onboard storage device and a power storage device, respectively. External port 150 and external port connector 154 are shown as being offset from a central plane of symmetry in mouthguard 100, but any placement of external port 150 and external port connector 154 is envisioned.

Power storage device can be an internal battery, a capacitor, or any other suitable device. Onboard storage device can be a flash memory device, or any other suitable storage device.

The controller 130 is configured to transmit a same audio signal to both speakers 120 or to transmit a different audio signal to both speakers 120. Furthermore, controller 130 is configured to transmit different audio signals from different sources to each speaker 120. For example, controller 130 can be configured to send right speaker 120 a wirelessly transmitted signal while simultaneously sending left speaker 120 an audio signal stored in onboard storage device.

Figure 5:
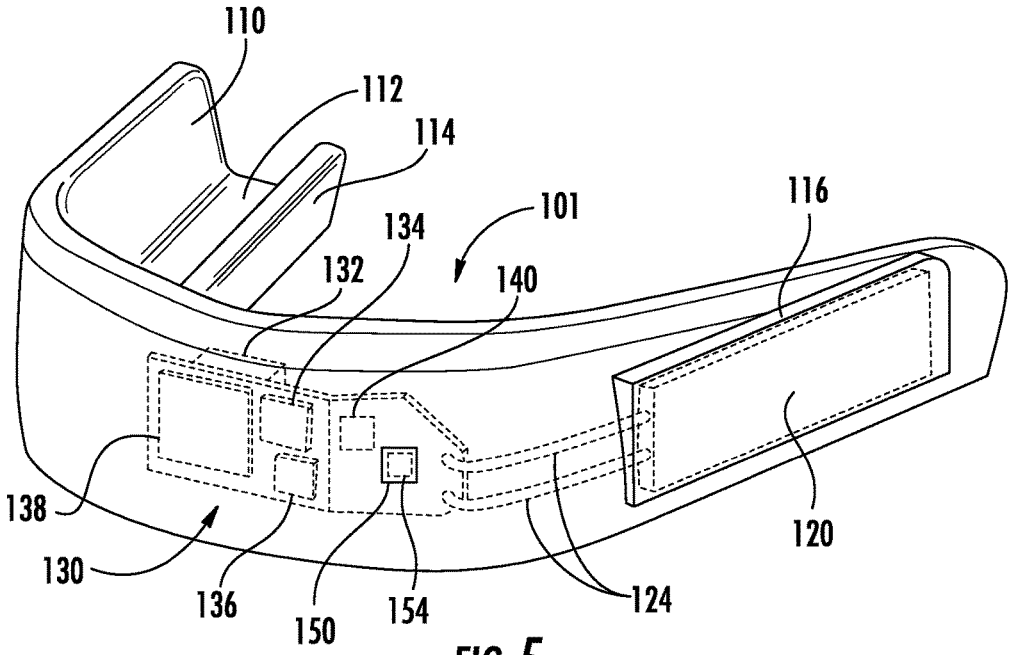
FIG. 5 is a perspective external view which also shows internal components of a mouthguard according to a second embodiment.

Referring now to FIG. 5, a mouthguard, generally designated 101, according to a second embodiment with only a single speaker 120 is shown. Mouthguard 101 is similar to mouthguard 101 in structure and functionality, however only one speaker protrusion 116 is provided rather than two speaker protrusions 116 in the first embodiment. As such, mouthguard 101 is only capable of transmitting a single audio source to the user at any given time via speaker 120. Mouthguard 101 has a controller 130 configured to receive, process, and transmit a single audio signal to the user. Just as in the first embodiment, controller 130 of mouthguard 101 has an external port 150, with an external port connector 154 being located behind external port 150, a power storage device 132, an SoC 134, an onboard storage device 136, a WiFi antenna 138, and a BLUETOOTH® antenna 140 which are shown as being mounted on controller 130. Unlike controller 130 of mouthguard 100, controller 130 of mouthguard 101 shows that BLUETOOTH® antenna 140 is located adjacent to external port 150.

Figure 6:
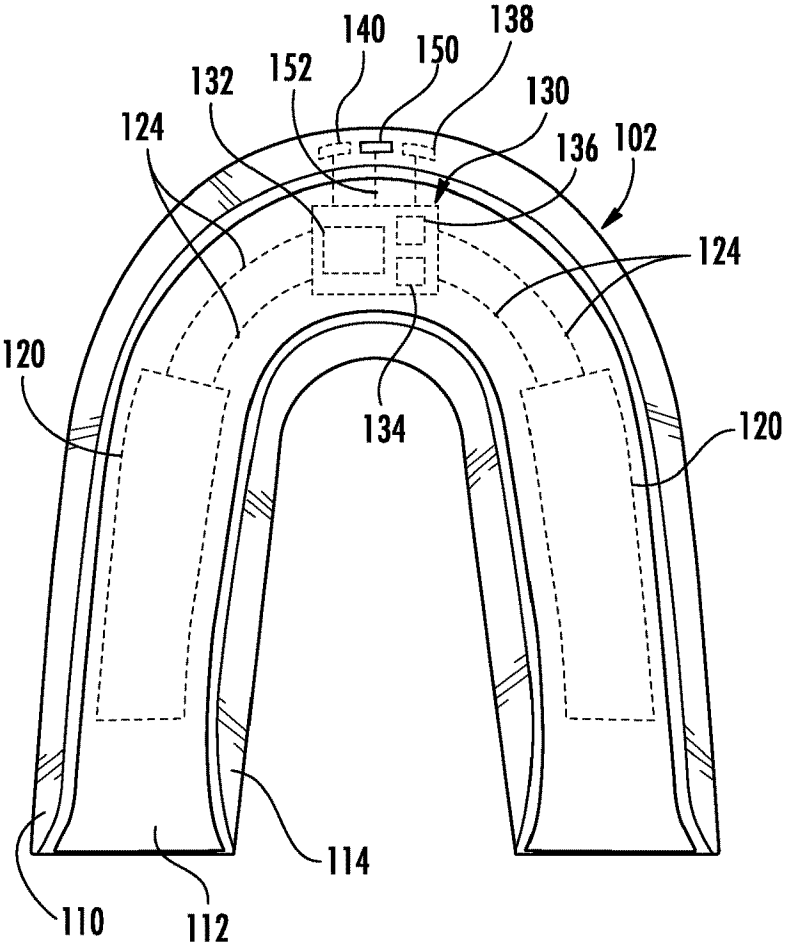
FIG. 6 is a top view of a mouthguard, which also shows internal components of a mouthguard according to a third embodiment.

Referring to FIG. 6, a mouthguard, generally designated 102, according to a third embodiment is shown. Mouthguard 102 has two speakers 120 which are embedded within an inner layer of bottom portion 112. As such, speakers 120 are configured to transmit an audio signal into the bottom surface of a user's teeth. Just as in the first embodiment, speakers 120 are connected to controller 130 by connecting wires 124. Controller 130 is connected to external port connector 154 by external port wire 152. External port connector 154 is covered by external port 150 when in a closed position. External port wire 152 is configured to transmit data and power from external port connector 154 to controller 130.

Just as with mouthguard 100, controller 130 of mouthguard 102 is configured to receive a data transmission from one or more antennas, process the data signal into an audio signal, and transmit an audio signal to one or both of speakers 120. Controller 130 of mouthguard 102 is configured to transmit different audio signals to each of speakers 120. Controller 130 has a power storage device 132, an SoC 134, and an onboard storage device 136 integrated thereon. BLUETOOTH® antenna 140 and WiFi antenna 138 are shown as being discrete components which are connected to controller 130, the antennas being molded into a front section of outer portion 110, adjacent to external port 150 to ensure optimal signal reception.

Figure 7:
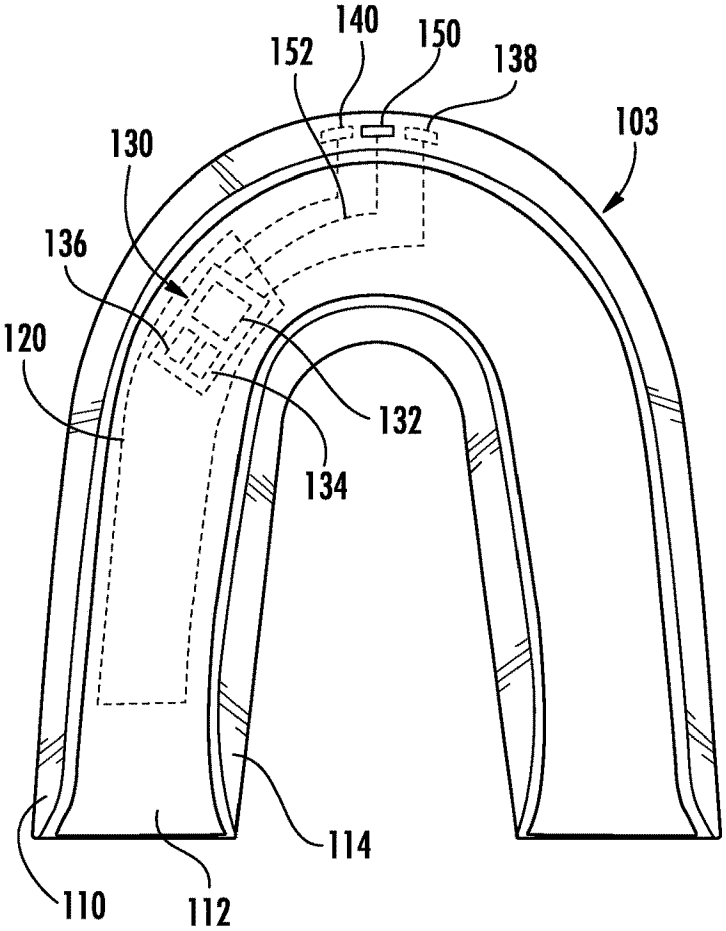
FIG. 7 is a top view of a mouthguard, which also shows internal components of a mouthguard according to a fourth embodiment.

Referring to FIG. 7, a mouthguard, generally designated 103, according to a fourth embodiment is shown. Mouthguard 103 is configured with a speaker 120 which is integral with controller 130, both of which are molded within bottom portion 112 of mouthguard 103. Controller 130 and speaker 120 are preferably disposed on one lateral portion of mouthguard 103, but can be located in any location where mouthguard 103 contacts the user's teeth. Controller 130 is configured to work as is described in the other embodiments and is connected to external port connector 154 by external port wire 152. Just as in mouthguard 102, controller 130 of mouthguard 103 has a power storage device 132, an SoC 134, and an onboard storage device 136 integrated thereon. Because of the location of controller 130 being located away from a front section of outer portion 110, it is preferable that BLUETOOTH® antenna 140 and WiFi antenna 138 be located along the front section of outer portion 110 of mouthguard 103 to ensure satisfactory antenna performance. As such, just as external port connector 154 is connected to controller 130 via an embedded external port wire 152, both BLUETOOTH® antenna 140 and WiFi antenna 138 are connected to controller 130 by embedded conductive wires. It is also contemplated that a single wire may be used to connect one or more of external port connector 154, BLUETOOTH® antenna 140, and WiFi antenna 138 to controller 130. The integration of controller 130 and speaker 120 enable a simplified assembly process and also reduce the likelihood of failure from fracture of one of connecting wires 124 which are present in the other three embodiments.

Figure 8:
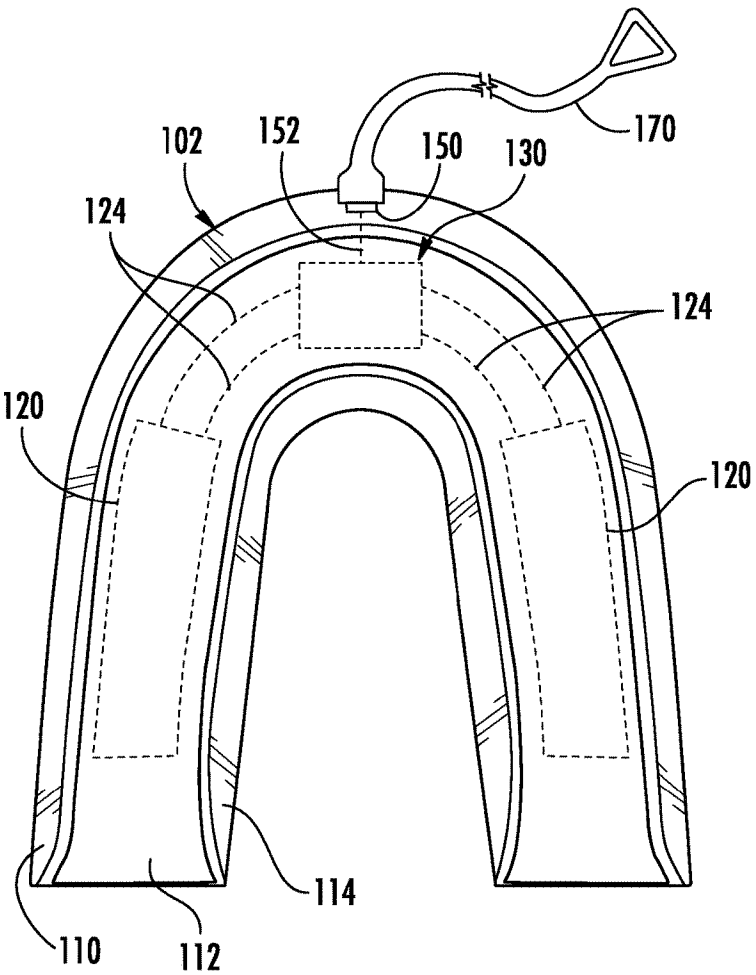
FIG. 8 is a top view of the mouthguard according to the third embodiment, the mouthguard being attached to a tether.

FIG. 8 shows an optional tether 170 removably but rigidly connected to external port 150 of a mouthguard 102. Tether 170 is configured to be attached to any of mouthguards 100-103, as well as any other embodiment of a mouthguard as enabled by the features discussed herein. Tether 170 is configured to attach to retention features of external port 150 in such a way as to not be dislodged without the retention features being deactivated such as, for example, by pressing a button to retract the retention features. Tether 170 may also be inserted and retained within mouthguard 102 via an interference fit. Tether 170 may be designed such that tether 170 will mechanically fail before the retention features of external port 150, thereby reducing the likelihood of mouthguard 102 being damaged when tether 170 is dislodged; by this feature, a new tether 170 can be attached to mouthguard 102 when an old tether 170 breaks rather than requiring replacement of the entire mouthguard 102. Tether 170 allows mouthguard 103 to be connected to a structure (e.g., a football helmet, not shown) in order to prevent the mouthguard from falling to the ground in case of being dislodged from the user's mouth, thereby reducing the chances of mouthguard 102 being damaged.

Figure 9:
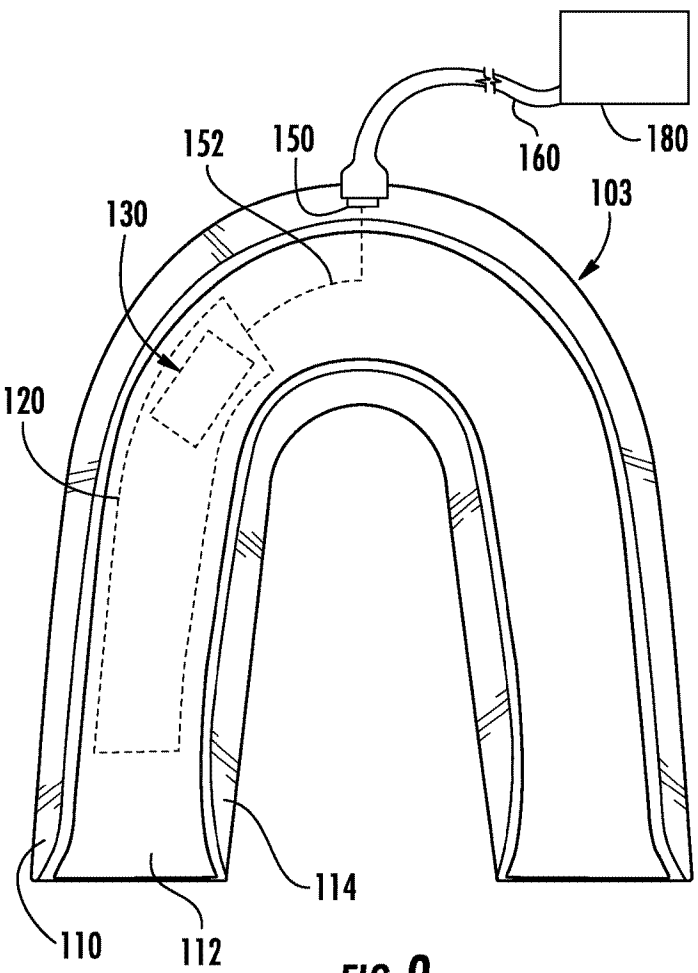
FIG. 9 is a top view of the mouthguard according to the fourth embodiment, the mouthguard being connected to a power source by a cable.

FIG. 9 shows a cable 160, configured to communicate with wired source 180, transmitting data and/or power to mouthguard 103 from wired source 180 to be stored in onboard storage device and/or power storage device, respectively. Just as with tether 170, cable 160 is configured to be attached to any of mouthguards 100-103, as well as any other embodiment of a mouthguard as enabled by the features discussed herein. Cable 160 is configured to attach to retention features of external port 150 in such a way as to not be dislodged without the retention features being deactivated. Cable may also be configured with no retention features, such that cable 160 can be unplugged from external port connector 154 with only minimal extraction force being required.

Figure 11:
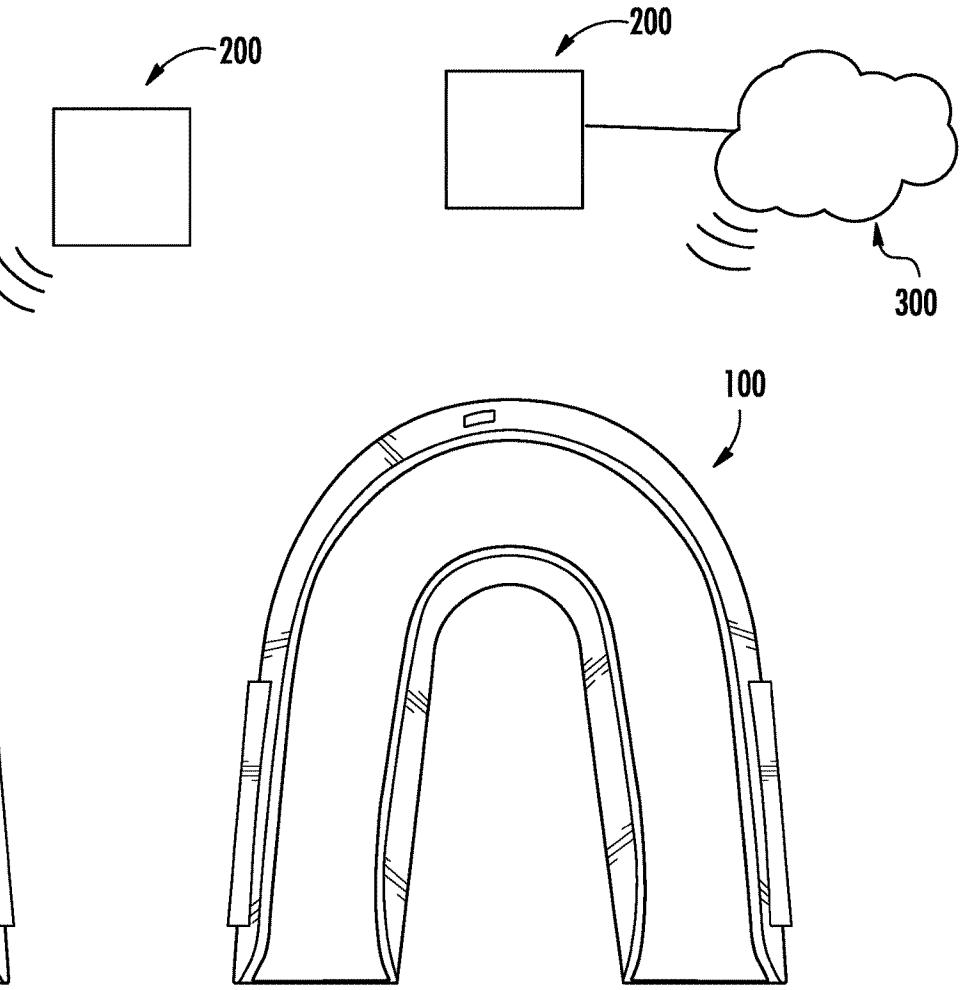
FIG. 11 is a schematic diagram of a wireless communications network using an external network.
Figure 10:
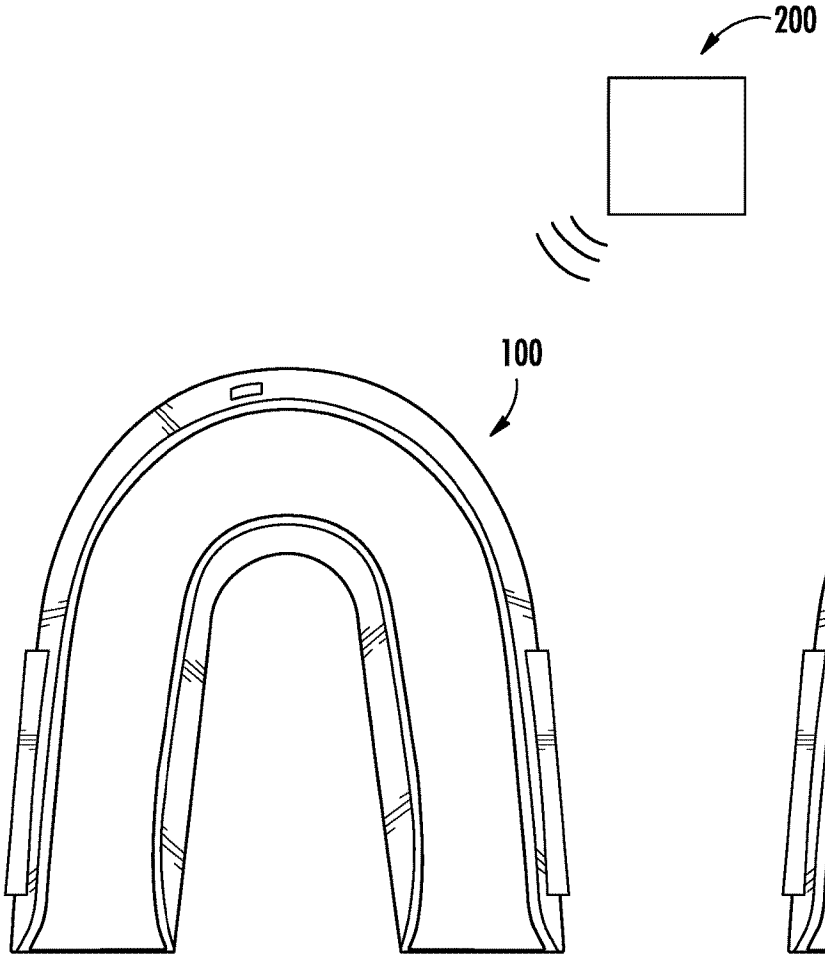
FIG. 10 is a schematic diagram of a wireless communications network using an "ad hoc" connection.

FIG. 10 shows an example system, including an external source 200 which transmits a data signal to mouthguard 100 via a wireless communication protocol (e.g., BLUETOOTH®). FIG. 11 shows a further example system, including external source 200 being connected to an external network 300, which then wirelessly transmits the data signal to mouthguard 100. It should also be noted that external source may be configured to transmit a data signal to a plurality of mouthguards 100 and, furthermore, to select any of the plurality of mouthguards 100 to receive the data signal.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

PARTS LIST

100—Mouthguard (1st Embodiment)
101—Mouthguard (2nd Embodiment)
102—Mouthguard (3rd Embodiment)
103—Mouthguard (4th Embodiment)
110—Outer Portion
112—Bottom Portion
114—Inner Portion
116—Speaker Protrusion
120—Speaker
124—Connecting Wires
130—Controller
132—Power Storage Device
134—System-on-Chip (SoC)
136—Onboard Storage Device
138—Wi-fi Antenna
140—Bluetooth Antenna
150—External Port
152—External Port Wire
154—External Port Connector
160—Cable
170—Tether
180—Wired Source
200—External Source
300—External Network

What is claimed is:

1. A mouthguard for wirelessly transmitting audio signals to a user via bone conduction, the mouthguard comprising:
an outer portion, a bottom portion, and an inner portion, the inner portion being separated from the outer portion by the bottom portion;
at least one wireless antenna;
at least one speaker; and
a controller configured to receive a signal and output the signal to the at least one speaker,
wherein each of the outer portion, the bottom portion, and the inner portion form an outer shell of the mouthguard, the outer shell comprising an inner surface, which faces towards teeth of the user, and an outer surface, which faces away from the teeth of the user, and
wherein the at least one speaker is embedded within the mouthguard, separated from the teeth of the user, and spaced apart from the inner surface of the mouthguard.

2. The mouthguard of claim 1, wherein the at least one speaker is embedded within the outer portion of the mouthguard and is separated from an inner surface of the outer portion.

3. The mouthguard of claim 1, wherein no part of the outer portion or the inner portion extends beyond a bottom surface of the bottom portion, and wherein the at least one speaker is embedded within the bottom portion of the mouthguard and is separated from the inner surface of the outer shell in the bottom portion of the mouthguard.

4. The mouthguard of claim 1, wherein the at least one wireless antenna is configured to receive data via one or more of BLUETOOTH®, WiFi, radio frequency (RF), and/or near-field communications (NFC) protocols.

5. The mouthguard of claim 1, wherein the at least one antenna, the at least one speaker, and the controller are internal to, and located between the outer surface and the inner surface of, the outer shell of the mouthguard.

6. The mouthguard of claim 1, comprising a power storage device or an onboard storage device.

7. The mouthguard of claim 1, wherein the mouthguard has a U-shape, with a first speaker on a first side of the U-shape and a second speaker on a second side of the U-shape, with the first and second sides being separated from each other and connected together by a front portion.

8. The mouthguard of claim 7, wherein the controller is configured to simultaneously transmit different audio signals to the first and second speakers.

9. The mouthguard of claim 8, wherein the different audio signals are stereo audio signals.

10. The mouthguard of claim 8, wherein the different audio signals are from separate audio sources.

11. The mouthguard of claim 1, wherein the mouthguard comprises multiple layers.

12. The mouthguard of claim 11, wherein the multiple layers comprise at least a plastic layer and a gel coating.

13. The mouthguard of claim 1, comprising a power storage device and an onboard storage device.

14. A system for wirelessly communicating audio signals to a user via bone conduction, the system comprising:

at least one mouthguard, each mouthguard comprising:

an outer portion, a bottom portion, and an inner portion, the inner portion being separated from the outer portion by the bottom portion;

at least one wireless antenna;

at least one speaker configured to transmit sound via bone conduction; and a controller configured to receive a signal and output the signal to the at least one speaker, wherein each of the outer portion, the bottom portion, and the inner portion form an outer shell of the mouthguard, the outer shell comprising an inner surface, which faces towards teeth of the user, and an outer surface, which faces away from the teeth of the user, and wherein the at least one speaker is embedded within the mouthguard, separated from the teeth of the user, and spaced apart from the inner surface of the mouthguard; and an external source configured to transmit the signal to the at least one mouthguard.

15. The system of claim 14, wherein the external source is configured to transmit the signal to the at least one mouthguard wirelessly.

16. The system of claim 14, wherein the external source is configured to transmit the signal to an external network, the external network being configured to wirelessly transmit the signal to the at least one mouthguard.

17. The system of claim 14, wherein the at least one mouthguard is a plurality of mouthguards.

18. The system of claim 17, wherein the external source is configured to transmit the signal to all or less than all of the plurality of mouthguards.

19. A method of wirelessly communicating audio signals to a user, the method comprising:

providing one or more mouthguards, each of the one or more mouthguards comprising:

an outer portion, a bottom portion, and an inner portion, the inner portion being separated from the outer portion by the bottom portion;

at least one wireless antenna;

at least one speaker configured to transmit sound via bone conduction; and a controller configured to receive a signal and output the signal to the at least one speaker, wherein each of the outer portion, the bottom portion, and the inner portion form an outer shell of the mouthguard, the outer shell comprising an inner surface, which faces towards teeth of the user, and an outer surface, which faces away from the teeth of the user, and wherein the at least one speaker is embedded within the mouthguard, separated from the teeth of the user, and spaced apart from the inner surface of the mouthguard;

wirelessly transmitting a signal to at least one of the one or more mouthguards;

receiving the signal by the at least one wireless antenna of the at least one of the one or more mouthguards;

processing the signal with the controller of the at least one of the one or more mouthguards; and sending the processed signal to the at least one speaker of the at least one of the one or more mouthguards.

20. The method of claim 19, wherein the signal is transmitted from an external source configured to transmit the signal to all or less than all of the one or more mouthguards.

* * * * *